US010598471B2

(12) United States Patent
Heymann et al.

(10) Patent No.: US 10,598,471 B2
(45) Date of Patent: Mar. 24, 2020

(54) SELF-CONSUMING PROJECTILE

(71) Applicant: RHEINMETALL WAFFE MUNITION GmbH, Unterluess (DE)

(72) Inventors: Frank Heymann, Oberndorf (DE); Gerhard Bilger, Lauterbach (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 91 days.

(21) Appl. No.: 15/947,125

(22) Filed: Apr. 6, 2018

(65) Prior Publication Data

US 2018/0224250 A1 Aug. 9, 2018

Related U.S. Application Data

(63) Continuation of application No. PCT/EP2016/072819, filed on Sep. 26, 2016.

(30) Foreign Application Priority Data

Oct. 6, 2015 (DE) ..... 10 2015 116 985

(51) Int. Cl.

| | |
|---|---|
| ***F42B 10/48*** | (2006.01) |
| ***F42B 12/74*** | (2006.01) |
| ***F42B 10/40*** | (2006.01) |
| ***F42B 12/44*** | (2006.01) |
| ***F42B 30/02*** | (2006.01) |
| *F42B 5/18* | (2006.01) |

(52) U.S. Cl.

CPC ..... *F42B 10/48* (2013.01); *F42B 10/40* (2013.01); *F42B 12/44* (2013.01); *F42B 12/745* (2013.01); *F42B 30/02* (2013.01); *F42B 5/181* (2013.01)

(58) Field of Classification Search

USPC ..... 102/346

See application file for complete search history.

(56) References Cited

U.S. PATENT DOCUMENTS

| | | | | |
|---|---|---|---|---|
| 3,250,216 | A | 5/1966 | Typaldos | |
| 3,633,512 | A * | 1/1972 | Schlack | F42B 12/38 102/513 |
| 4,130,061 | A | 12/1978 | Boggs et al. | |
| 5,467,713 | A | 11/1995 | Roosmann et al. | |

(Continued)

FOREIGN PATENT DOCUMENTS

| | | | |
|---|---|---|---|
| DE | 4335022 | C2 | 4/1995 |
| DE | 10020037 | C1 | 8/2001 |

(Continued)

OTHER PUBLICATIONS

International Search Report dated Nov. 22, 2016 in corresponding application PCT/EP2016/072819.

*Primary Examiner* — Reginald S Tillman, Jr.

(74) *Attorney, Agent, or Firm* — Muncy, Geissler, Olds & Lowe, P.C.

(57) ABSTRACT

A projectile with a projectile casing and at least one pyrotechnic charge incorporated in the projectile casing is proposed, wherein the projectile has an open projectile base with a destructible membrane and the pyrotechnic charge burns away at a defined rate during the flight of the projectile, and so the projectile loses mass in such a way that a predetermined effective range is not exceeded. As a result, safety and a nonlethal effect are achieved, in particular outside the effective range.

7 Claims, 1 Drawing Sheet

(56) References Cited

U.S. PATENT DOCUMENTS

| | | | | |
|---|---|---|---|---|
| 6,523,476 | B1 | 2/2003 | Riess et al. | |
| 6,865,989 | B2 | 3/2005 | Kölbli | |
| 9,121,679 | B1 * | 9/2015 | Kim | F42B 8/12 |
| 2002/0152914 | A1 | 10/2002 | Cox | |

FOREIGN PATENT DOCUMENTS

| | | | |
|---|---|---|---|
| DE | 10 2005 030 263 | B3 | 11/2006 |
| DE | 10 2012 014 149 | B3 | 7/2013 |
| DE | 102012014150 | A1 | 1/2014 |
| DE | 10 2013 013 705 | A1 | 2/2015 |
| EP | 0169171 | A1 | 1/1986 |
| EP | 1123482 | A1 | 8/2001 |

* cited by examiner

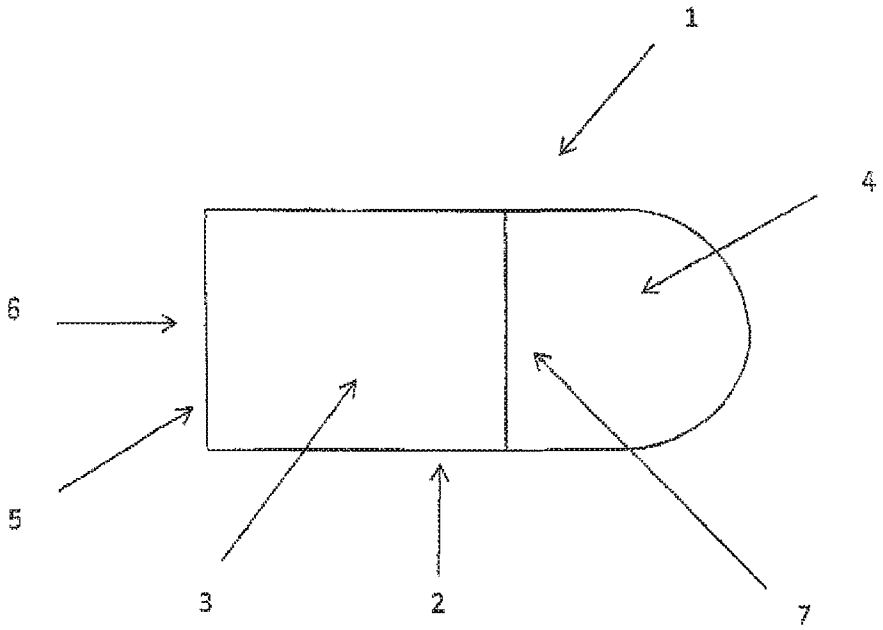
1
2
3
4
5
6
7

SELF-CONSUMING PROJECTILE

This nonprovisional application is a continuation of International Application No. PCT/EP2016/072819, which was filed on Sep. 26, 2016, and which claims priority to German Patent Application No. 10 2015 116 985.1, which was filed in Germany on Oct. 6, 2015, and which are both herein incorporated by reference.

BACKGROUND OF THE INVENTION

Field of the Invention

The present invention relates to a so-called self-consuming projectile or ammunition, also a training projectile or training ammunition that is effective up to a predefined effective range, otherwise the speed reduces very rapidly on exceeding said range.

Description of the Background Art

From DE 10 2005 030 263 B3, a safety system for time-delay ammunition with self-destruction is known. In this case, a self-destruction mechanism remains active until a check on the functioning of a fuse is terminated. In the event of a negative result, self-destruction is carried out, which is thus placed at the start of the mission. Further self-destruction devices can be seen in DE 100 20 037 C1 or DE 43 35 022 C2.

Combat ammunition is known in which tracer integrated within the rear of the projectile is used shortly before the end of the burn duration thereof to ignite the explosive charge integrated within the projectile. As a result, duds are prevented from lying around in the battlefield if the combat ammunition has not hit the target. It is a disadvantage that the necessary reliability of the self-destruction is not always guaranteed.

Conventional projectiles comprise a particularly high muzzle energy according to the muzzle velocity thereof and the projectile weight thereof. However, this is often decreased exclusively by the air resistance during flight. This results in a large firing range depending on the launching angle. This lies at a flight range of up to 2000 m for calibers in the hand gun range. In particular however, for the 9×19 mm caliber the effective range should only lie in the range up to 200 m. Even at these ranges such projectiles still comprise sufficient residual energy to cause serious injuries etc. Such projectiles comprise no self-destruction mechanisms.

SUMMARY OF THE INVENTION

It is therefore an object of the invention to provide an ammunition having an effect (energy) up to a defined range and with a very rapid reduction of the energy thereafter. A specifiable range is not to be exceeded so that there is no danger beyond the range.

In an exemplary embodiment, the invention is based on the idea of specifying ammunition or a projectile that is not subject to any external ballistic disturbances in a so-called main combat range, but which can then very rapidly reduce speed if the target has not been hit. In particular, in the case of training ammunition, as far as possible this must have the same properties within the main training combat range as the corresponding combat ammunition but must then be able to reduce speed much more rapidly.

The speed reduction is carried out according to the invention by the projectile self-destructing after a defined time or after a defined flight distance, i.e. reducing itself, minimizing the own weight thereof and thereby eliminating itself. The weight reduction and thus the elimination are carried out by incorporating at least one pyrotechnic set in the projectile that determines the weight or the mass of the projectile and that is only ignited on exceeding the effective range. As a result, the projectile loses weight or mass over the flying time or the flight distance. The projectile is adapted to the desired effective range by means of the burn rate of the pyrotechnic set thereof.

The projectile has a projectile casing, for example of a metal or a plastic. The casing is filled with at least one pyrotechnic set. The casing and the pyrotechnic set together form the projectile, i.e. the launch weight and the effective weight of the initial mass of the projectile. A propellant charge that is not represented in detail of ammunition that is also not represented in detail ignites the pyrotechnic set during launching. The pyrotechnic set then burns at a defined rate during the flight phase or flying time. Said defined combustion can be adjusted by the composition of the pyrotechnic mixture of the set. Adjustment by selecting the volume of the set is also possible. Combinations of known options are known to the person skilled in the art and can be used here. The burn rate must be adjusted so that the speed and mass of the projectile in the defined effective range still comprise the required energy and guarantee operability.

For incremental combustion, two or more sets are to be provided. Different pyrotechnic sets are then preferably also incorporated.

The incorporation of delay paths (delay elements) can also be provided here.

Once the pyrotechnic set or the pyrotechnic sets has/have been burnt, the light casing remains, so that the residual energy or residual speed is reduced more rapidly. Alternatively, the casing can also burn during the burning of the pyrotechnic set, or thereafter, so that the projectile is completely consumed. Combustible casing material is known, for example, from EP 1 123 482 B1, which corresponds to U.S. Pat. No. 6,523,476, and which is incorporated herein by reference.

Such projectiles can preferably be used with launching angles >30° in order to ensure non-lethality. It is important that the pyrotechnic set burns until the projectile hits the ground, so that, if anything, only the light projectile casing falls to earth with low residual energy. Said projectiles are particularly suitable for non-lethal combat against air targets or light air targets, such as drones.

By said structural measure or measures, it is guaranteed that for the effective area or the effective range, the ammunition has identical external ballistic properties (flight path) to the corresponding combat ammunition, but a maximum total range will not be exceeded. As a result, in general safety is increased.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawing which is given by way of illustration only, and thus, is not limitive of the present invention, and wherein the sole FIGURE illustrates an example embodiment, showing a projectile with a projectile casing or projectile body.

DETAILED DESCRIPTION

Using an exemplary embodiment with a drawing, the invention is described in detail. The single FIGURE shows a projectile 1 with a projectile casing or projectile body 2 in sketch form and in said exemplary embodiment two pyrotechnic sets 3, 4 incorporated in the projectile casing 2. Both sets 3, 4 enable incremental burning. The projectile 1 or the projectile body 2 comprises an open projectile base 5 that is closed until launch by a destructible membrane 6. A membrane 7 can be introduced between the two pyrotechnic sets 3, 4.

The pyrotechnic set 3 is ignited during launching of the projectile 1 from a launch tube or gun barrel that is not represented in detail. Said ignition can be carried out directly. The pyrotechnic set 3 is dimensioned (volume, mixture etc.) so that the same ignites the further pyrotechnic set 4 only if an effective range for the projectile 1 is exceeded.

The ignition of the pyrotechnic set 3 can however also be carried out with a delay. Delay elements and the adjustment thereof are discussed for example in DE 10 2013 013 705 A1, DE 10 2012 014 150 A1 or DE 10 2012 014 149 B3, which are all incorporated herein by reference.

By the implementation of the pyrotechnic sets 3 and 4, the projectile 1 loses mass or weight. The mass tends to zero. As a result, a small residual mass of the projectile 1 is guaranteed beyond the effective range. Safety is increased, and a non-lethal effect of the residual projectile is in particular achieved beyond the effective range.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A projectile comprising: a projectile casing;

a first pyrotechnic set incorporated in the projectile casing; a second pyrotechnic set incorporated in the projectile casing and separated from the first pyrotechnic set; and an open projectile base with a destructible membrane, wherein the first pyrotechnic set is configured to ignite during launching of the projectile and is configured to ignite the second pyrotechnic set, and wherein the first pyrotechnic set burns during a flight of the projectile at a defined rate so that the projectile loses mass such that a predefined effective range is not exceeded.

2. A projectile comprising: a projectile casing;

at least two pyrotechnic sets incorporated in the projectile casing; and an open projectile base with a destructible membrane, wherein the at least two pyrotechnic sets burns during a flight of the projectile at a defined rate so that the projectile loses mass such that a predefined effective range is not exceeded, and wherein at least one membrane is introduced between the at least two pyrotechnic sets.

3. The projectile as claimed in claim 1, wherein delay paths are incorporated.

4. The projectile as claimed in claim 1, wherein the projectile casing is formed of a metal, steel or aluminum.

5. The projectile as claimed in claim 1, wherein the projectile casing is formed of a plastic.

6. A projectile comprising: a projectile casing;

at least one pyrotechnic set incorporated in the projectile casing; and an open projectile base with a destructible membrane, wherein the at least one pyrotechnic set burns during a flight of the projectile at a defined rate so that the projectile loses mass such that a predefined effective range is not exceeded and wherein the projectile casing includes a combustible material.

7. A projectile comprising: a projectile casing;

a first pyrotechnic set incorporated in the projectile casing; a second pyrotechnic set incorporated in the projectile casing and separated from the first pyrotechnic set; and an open projectile base with a destructible membrane, wherein the first pyrotechnic set is configured to ignite during launching of the projectile and is configured to ignite the second pyrotechnic set only if a predefined effective range for the projectile is exceeded.

* * * * *